US005229978A

United States Patent [19]

Flanagan et al.

[11] Patent Number: 5,229,978

[45] Date of Patent: Jul. 20, 1993

[54] ELECTRO-ACOUSTIC TRANSDUCERS

[75] Inventors: Peter F. Flanagan, Cranston, R.I.; William M. Pozzo, N. Easton; James E. Burke, Somerset, both of Mass.

[73] Assignee: Raytheon Company, Lexington, Mass.

[21] Appl. No.: 780,079

[22] Filed: Oct. 4, 1991

[51] Int. Cl.[5] ..... H04R 17/00

[52] U.S. Cl. ..... 367/157; 367/159; 367/163; 310/337

[58] Field of Search ..... 310/337, 334; 367/157-159, 165, 163, 174

[56] References Cited

U.S. PATENT DOCUMENTS

| | | | |
|---|---|---|---|
| 4,651,044 | 3/1987 | Kompanek | 310/323 |
| 4,774,427 | 9/1988 | Plambeck | 310/321 |
| 4,941,202 | 7/1990 | Upton | 367/165 |
| 5,020,035 | 5/1991 | Kompanek | 367/159 |

OTHER PUBLICATIONS

The Random House College Dictionary, 1980 Random House, Inc. p. 1493.

*Primary Examiner*—J. Woodrow Eldred

*Attorney, Agent, or Firm*—Donald F. Mofford; Richard M. Sharkansky

[57] ABSTRACT

A composite split cylinder transducer comprises an electromechanical driver and a cylindrical shell having a longitudinal gap. The shell further has a portion, disposed opposite the gap, comprised of a high strength material having increased stiffness. Transducers of this configuration are capable of being employed at greater ocean depths where high hydrostatic pressure conditions exist with little effect on acoustic performance.

6 Claims, 1 Drawing Sheet

ELECTRO-ACOUSTIC TRANSDUCERS

BACKGROUND OF THE INVENTION

This invention relates generally to electro-acoustic transducers and more particularly to split-ring cylindrical transducers.

As is known in the art, a transducer is a device that converts energy from one form to another. In underwater acoustic systems, transducers generally are used to provide an electrical output signal in response to an acoustic input which propagates through a body of water or an acoustic output into the body of water in response to an input electrical signal.

An underwater acoustic transducer designed primarily for producing an electrical output in response to an acoustic input is called a hydrophone. Hydrophones are typically designed to operate over broad frequency ranges and are also generally small in size relative to the wavelength of the highest intended operating frequency.

A transducer intended primarily for the generation of an acoustic output signal in response to an electrical input is generally referred to as a projector. Projector dimensions are typically of the same order of magnitude as the operating wavelength of the projector. Moreover, projectors are generally narrowband devices, particularly compared to hydrophones. Both hydrophone and projector transducers are widely employed in sonar systems used for submarine and surface-ship applications.

Projectors generally include a mechanically driven member such as a piston, tube, or cylinder and a driver. The driver is responsive to electrical energy and converts such energy into mechanical energy to drive the mechanically driven member. The driven member converts the mechanical energy into acoustic waves which propagate in the body of water. Most acoustic transducers have driver elements which use materials having either magnetostrictive or piezoelectric properties. Magnetostrictive materials change dimension in the presence of an applied magnetic field, whereas piezoelectric materials undergo mechanical deformation in the presence of an electrical field. Because ceramic materials used in piezoelectric ceramic drivers are generally incapable of supporting tensile stresses, which often leads to fracturing of the ceramic, it is generally required that the ceramic driver be placed in a condition of precompression or prestress. Precompression protects the ceramic element from tensile forces which are generally detrimental to ceramic piezoelectrics.

Because acoustic transducers are used in a wide variety of applications, their size, shape and mode of operation can be quite different.

A configuration for acoustic transducers used when light weight and small size is needed is the split-ring cylindrical transducer. A split-ring transducer generally includes a hollow tube having a longitudinal gap extending the length of the tube and a cylindrical ceramic driver having a longitudinal gap at an angular displacement, such that when the driver is disposed within the tube, the respective gaps are generally aligned. In one configuration, a cylindrical ceramic driver has electrodes on the inner and outer surfaces and is polarized in a manner such that when an alternating current is applied across the electrodes, the driver causes the hollow tube to expand and contract in the radial direction. Accordingly, the ceramic driver and the hoop-mode projector are said to operate in the radial mode. The "C" shaped projector vibrates similarly to a tuning fork with the motion of the centers of vibration on either side of the diametral plane of the split having a large displacement normal to the plane as compared to the point diametrically opposite the split, which has a relatively small displacement. The resonant frequency of the split-ring projector is a function of the diameter as well as the thickness and elasticity modulus of the tube and ceramic driver materials.

One problem with acoustic transducers, in general, is that with increasing ocean depth, hydrostatic pressure conditions increase to levels capable of fracturing the elements of the driver or collapsing the shell.

As is known by those of skill in the art, solutions to this problem include increasing the wall thickness of the shell, pressure compensating the transducer using inflatable bladders, or providing passive pretension to the shell.

Although a shell with an increased wall thickness provides a transducer capable of withstanding increased levels of hydrostatic pressure, the size of the transducer is correspondingly increased. However, this solution may not be acceptable in applications where the size of the transducers is required to be small. For example, sonar systems using transducers as sonobuoys are required to be small in order to facilitate their launching and deployment.

Pressure compensation of the transducer using bladders are generally only effective if the transducer is used at a particular ocean depth. Use of the transducer at a different depth where the hydrostatic pressure conditions are different would change the operating characteristics of the transducer. Active gas compensators, where the amount of pressure is variable, may be used in some applications, but are expensive and require recharging after each use.

The concept of passive pretension is accomplished such that the hydrostatic pressure does not provide stress to the driver elements, until the pressure overcomes the shell prestress. In the case of a split-ring transducer, prestress is generally applied to the cylindrical ceramic driver by using a split hollow tube having a diameter somewhat smaller than the diameter of the ceramic cylinder driver. The opposing arms or curved members of the tube are spread apart sufficiently for inserting the cylindrical ceramic element within the tube. Releasing the spreading forces on the opposing arms allows the tube to wrap itself around the ceramic driver and places the driver in compression. However, at very deep ocean depths, many of the materials used in fabricating transducer shells are unable to withstand the high hydrostatic pressure conditions that exist in these environments.

For example, a material suitable for use in fabricating split hollow tubes, aluminum 7075T6, typically yields at stress levels greater than 72,000 psi. For "A" size sonobuoy transducers limited to an outside diameter of 4.875 inches, an ocean depth of approximately 140 feet is sufficient for transferring the outside hydrostatic pressure load to the internal elements (i.e., electromechanical driver). This is well above ocean depths where transducers having limited size and good acoustic performance are required.

SUMMARY OF THE INVENTION

In accordance with the present invention, a shell for use in a flexural transducer includes a hollow tube having a length and a longitudinal gap extending along the length. The hollow tube has a first portion having a first tensile strength characteristic and a second portion having a second tensile strength characteristic different than the first tensile strength characteristic. With such an arrangement, the hollow tube having portions with different tensile strength characteristics provides a shell having a portion with increased mechanical support and rigidity which can be used at increased ocean depths where high hydrostatic pressure conditions are capable of collapsing the shell.

In accordance with a further aspect of the invention, a flexural transducer includes a hollow tube having a length and a longitudinal gap extending along the length. The hollow tube has first and second portions fabricated with aluminum and a third portion fabricated from beryllium copper disposed between the first and second portions at a location substantially opposite the longitudinal gap. The flextensional transducer further includes an electromechanical driver disposed within the hollow tube. With such an arrangement, a flexural transducer includes a shell having first and second portions having characteristics of light weight, high thermal conductivity, and low cost and a third portion disposed between the first and second portions, having the characteristic of high tensile strength. The third portion is generally disposed at a high stress area of the shell when operated. In this configuration, the first and second portions assure good acoustic performance of the transducer and the third portion allows the transducer to be operated at ocean depths where significant hydrostatic pressure conditions normally induce high stresses to conventional transducers, rendering them inoperable or in disrepair.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENT

Figure 1:
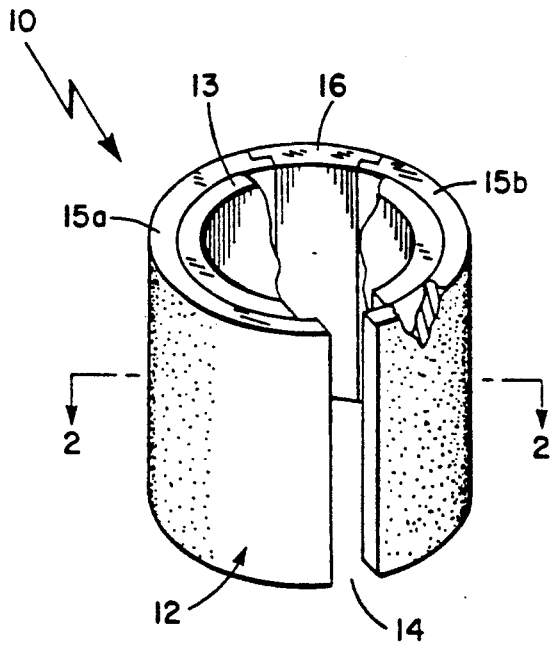
FIG. 1 is an exploded, somewhat diagrammatical, isometric view of a split-ring cylindrical transducer having a composite transducer shell assembly.
Figure 2:
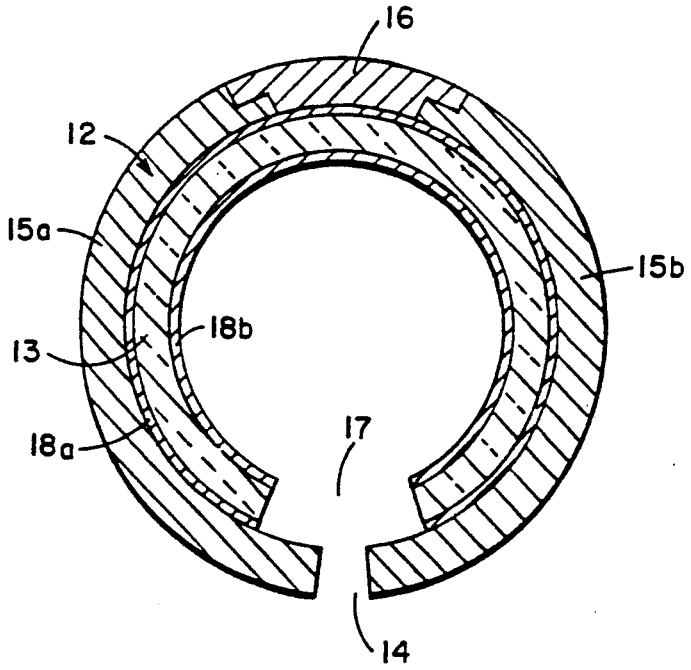
FIG. 2 is a cross sectional view of a portion of a split-ring cylindrical transducer taken along lines 2—2 of FIG. 1.

Referring now to FIGS. 1 and 2, a split ring transducer 10 is shown to include a hollow tube 12 having a longitudinal gap 14 along the length of the tube 12 and a cylindrical electromechanical driver assembly 13 bonded to an inner surface of the hollow tube 12.

In general, a hollow tube 12 includes a first portion fabricated with a material having a tensile strength characteristic and a second portion fabricated with a material having a different tensile strength characteristic. In a preferred embodiment, the hollow tube 12 includes a pair of curved members 15*a*, 15*b* fabricated generally with a relatively strong and lightweight material, here aluminum, and a wedge section 16 disposed between the curved members 15*a*, 15*b* at a point along the tube disposed diametrically opposite to the gap 14. The wedge section 16 has a circumferential length corresponding to a radial distance extending here, approximately 30° along either side of the point opposite the gap. The wedge section 16 is fabricated with a material, here beryllium copper, having a tensile strength characteristic which is greater than a tensile strength characteristic of the material of the curved members 15*a*, 15*b*, as will be discussed in greater detail below. The wedge section 16 is generally brazed between the curved members 15*a*, 15*b* to form the complete tube 12, using conventional brazing or soldering techniques such that a solid joint capable of withstanding repeated flexure without fracturing is provided.

The cylindrical electromechanical driver 13 is generally bonded with an epoxy adhesive to an inner surface of the hollow tube 12 such as an epoxy manufactured by Magnolia Plastics, Inc., Chamblee, Ga., Product No. 95-215. The electromechanical driver 13 has a driver slot 17 at essentially the same angular location of the longitudinal gap 14 of tube 12. That is, the driver being disposed within the tube has its gap 17 generally aligned with the gap 14 of the tube.

The cylindrical electromechanical driver 13 is constructed from a piezoelectric ceramic, here PZT (lead zirconate titanate) ceramic having silver-coated electrical conductors 18*a*, 18*b* disposed on the inner and outer cylindrical surfaces of the ceramic driver 13. In this configuration, a polarizing field is applied between the inner and outer surfaces and is said to operate in the radial mode.

The electromechanical driver 13 is disposed in the hollow tube 12 under a predetermined compression or "prestress" condition. Prestress compression on the driver is necessary for generally preventing damage to the ceramic element due to tensile stresses induced by the applied electrical signal. Assembly of the driver 13 to the split hollow tube 12 is typically accomplished by having equal diameters. Spreading the opposing arms of the tube 12 sufficiently for disposing the driver within the tube and releasing the spreading forces on the arms permits the tube 12 to wrap around the driver 13. Prestress is achieved by the outside pressure on the tube compressing the ceramic.

In operation, an electrical signal is applied to the cylindrical electromechanical driver 13 to cause the split cylindrical hollow tube 12 to vibrate. The hollow tube 12 operates similarly to a tuning fork, having two equal length cantilever arms substantially corresponding to structural members 15*a*, 15*b*.

Acoustic transducers are often used at ocean depths where hydrostatic pressure levels generate stresses capable of collapsing the shell 12 and damaging the internal elements of the transducer 10. The types of stresses experienced by the shell 12 in response to hydrostatic pressure include bending stresses, shear stresses, and normal stresses.

In the case of a transducer having a cylindrical geometry, the predominant stresses experienced by the shell 12 are bending stresses. For a cylindrical shell geometry, the bending stress $\sigma_\theta$ may be expressed by the following relationship:

$$\sigma_{\theta\theta} = \frac{P_o\,(b/a)^2}{(b/a - 1)(r_o^2/a - b/a)}\,(1 + \cos\theta)(1 - r_o^2/r^2)$$

-continued $$\text{where } r_o^2 = \frac{b_2 - a^2}{\ln (b/a)^2}$$

and $P_{o\,externally\ applied\ pressure\ (lb/in^2)}$ a= inner radius of the shell (in)

b= outer radius of the shell (in)

r= radial distance within the shell (in)

$\theta$ angle relative to neutral axis defined by a plane passing from: the midpoint of the gap 14 of the tube through the center of the cylinder It is apparent from the above relationship that the bending stress is largest when $\theta=0°$ and r approaches the outer radius of the shell. Consequently, the maximum bending stress experienced by the shell is located at a point opposite the midpoint of the gap 14 of the tube and along the outer surface of the shell.

Other stresses occurring within the shell are shear stresses. Generally, the forces of shear stress exerted upon each other are parallel but in different directions. In a cylindrical geometry, these forces are in circumferential directions. In other words, the shear stress is zero along the inner and outer walls of the shell in response to the external hydrostatic pressure; however, shear stress increases radially from both inner and outer surfaces of the shell in different directions until an imaginary plane within the shell thickness is reached where the clockwise and counterclockwise forces resist each other. It is along this imaginary plane that the shear stress is maximum. For the cylindrical geometry, the shear stress $\sigma_\theta$ may be expressed by:

$$\sigma_{r\theta} = \frac{P_o\,(b/a)^2}{2(b/a - 1)(r_o^2/a^2 - b/a)} \sin\theta(1 - a^2/r^2 - r_o^2/r^2 \ln (r/a)^2)$$

Unlike the previously discussed bending stress $\sigma_\theta$, the shear stress is greatest when $\theta=90°$. However, shear stresses are generally of secondary magnitude when compared to the bending stress.

The normal stress in response to the external hydrostatic pressure may be expressed by:

$$\sigma_{rr} = \sigma_{r\theta} \operatorname{cotan}(\theta) + \frac{P_o\,(b/a)^2}{(b/a - 1)(r_o^2/a^2 - b/a)} (1 - a/r)(1 - r_o^2/ar)$$

The normal stress, or radial stress, in the case of a cylindrical transducer is maximum at the outer radius and is generally of smaller magnitude relative to both bending and shear stresses.

As shown in the previous paragraphs, relationships relating to the various types of stresses generated within a cylindrical shell can be used to analyze the generated stresses in the transducer tube 12, in response to hydrostatic pressure, given the tube geometry and selected materials for the tube 12 and electromechanical driver 13. Alternatively, a finite element computer program, here ANSYS, a product of Swanson Analysis Corporation, Houston, Pa., may also be used to determine the magnitude and location of the stresses. Analysis has shown that the portion of the tube 12 extending approximately 30° along either side of the location diametrically opposite the midpoint of the gap experiences much greater stresses than the remaining portions of the tube 12. Accordingly, wedge element 16 being fabricated from a high-strength material such as beryllium copper, steel, or titanium provides increased mechanical support and rigidity to the high-stressed portion of the tube 12. In addition, the substitution of the high-strength material into the tube 12 provides relatively little change to the acoustic performance of the transducer 10 As stated earlier, for a given tube geometry, a flextensional transducer having a shell fabricated completely with aluminum may be used at ocean depths down to approximately 140 feet. Beyond this depth, the hydrostatic pressure conditions increase to levels capable of collapsing the aluminum shell. Because the pair of curved members 15*a*, 15*b* constitute the majority of the shell 12 and are fabricated with a lighter weight, higher thermal conductivity material, such as aluminum, the transducer material costs are relatively low. Analysis has shown that for the same tube geometry, a wedge element fabricated in beryllium copper provides a 4% increase in the transducer resonant frequency while allowing the transducer 10 to be used at an increased depth of approximately 225 feet. For the same tube geometry, a wedge element fabricated in steel provides a 10% increase in the transducer frequency while concomitantly allowing the transducer to be used at an increased depth of 540 feet. In both situations, the substitution of the high-strength material into the shell has little effect on the bandwidth of the transducer. The capability of using the transducer 10 at the increased ocean depth is provided without the need for active compensation; therefore, no additional care or maintenance is required.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A shell for use in a flexural transducer comprising a hollow tube having a length and a longitudinal gap extending along said length, said tube having a first portion having a first tensile strength characteristic and a second portion having a second tensile strength characteristic different than said first tensile strength characteristic; wherein said tube further comprise a third portion having a third tensile strength characteristic being the same as said first tensile strength characteristic, and wherein said second portion is disposed between said first and third portions at a location substantially opposite said longitudinal gap.

2. The shell as recited in claim 1 wherein said second portion has an angular length approximately that of an arc length established by a point along the periphery of said tube opposite a midpoint of said gap and extending approximately 30° on either side of said point.

3. The shell as recited in claim 1 wherein said first, second, and third portions are bonded together.

4. The shell as recited in claim 2 wherein the first tensile strength characteristic is than 30,000 psi and said second tensile strength characteristic is greater than 75,000 psi.

5. A flexural transducer comprising:

a) a hollow tube having a length and a longitudinal gap extending along said length, said tube having first and second portions fabricated with aluminum and a third portion disposed between said first and second portions at a location substantially opposite said longitudinal gap, said third portion being fabricated with beryllium copper; and b) an electromechanical driver disposed within said tube.

6. The flexural transducer as recited in claim 5 wherein said second portion has an angular length approximately that of an arc length established by a point along the periphery of said tube opposite a midpoint of said gap and extending approximately 30° on either side of said point.

* * * * *